US011420241B2

(12) United States Patent
Liu et al.

(10) Patent No.: US 11,420,241 B2
(45) Date of Patent: Aug. 23, 2022

(54) METHOD FOR PREPARING ULTRAFINE-GRAINED SUPERALLOY BAR

(71) Applicant: Northwestern Polytechnical University, Xi'an (CN)

(72) Inventors: Dong Liu, Xi'an (CN); Jianguo Wang, Xi'an (CN); Yanhui Yang, Xi'an (CN)

(73) Assignee: NORTHWESTERN POLYTECHNICAL UNIVERSITY, Xi'an (CN)

( * ) Notice: Subject to any disclaimer, the term of this patent is extended or adjusted under 35 U.S.C. 154(b) by 176 days.

(21) Appl. No.: 16/804,071

(22) Filed: Feb. 28, 2020

(65) Prior Publication Data

US 2020/0276624 A1 Sep. 3, 2020

(30) Foreign Application Priority Data

Feb. 28, 2019 (CN) ..... 201910151226.4

(51) Int. Cl.

| | |
|---|---|
| ***B21B 1/16*** | (2006.01) |
| ***B21B 27/02*** | (2006.01) |
| ***B21B 27/10*** | (2006.01) |
| *C22F 1/11* | (2006.01) |
| *C22F 1/10* | (2006.01) |

(52) U.S. Cl.

CPC ..... *B21B 1/16* (2013.01); *B21B 27/025* (2013.01); *B21B 27/106* (2013.01); *C22F 1/10* (2013.01); *C22F 1/11* (2013.01)

(58) Field of Classification Search

CPC ..... B21B 1/16; B21B 1/20; B21B 13/008; B21B 13/20; B21B 19/00; B21B 19/02; B21B 19/06; B21B 27/025

See application file for complete search history.

(56) References Cited

U.S. PATENT DOCUMENTS 2,099,497 A * 11/1937 Offutt ..... B21B 19/04 72/100
3,132,545 A * 5/1964 Arata ..... B21B 19/06 72/100
3,495,429 A * 2/1970 Muller ..... B21B 19/06 72/100
3,735,617 A * 5/1973 Bretschneider ..... B21B 1/20 72/78

(Continued)

*Primary Examiner* — Edward T Tolan

(74) *Attorney, Agent, or Firm* — Matthias Scholl P.C.; Matthias Scholl

(57) ABSTRACT

A method for preparing an ultrafine-grained superalloy bar, the method including: 1) designing a rolling machine including two rollers and two guide plates, where each of the two rollers includes a first roller and a second roller; the first roller includes a first curve and the second roller includes a second curve; the first curve and the second curve form a generatrix of the two rollers; 2) disposing the two guide plates with two curved surfaces thereof opposite to each other; disposing the two rollers to be between the two guide plates; where the two rollers and the two guide plates form a deformation zone of the rolling machine; and 3) driving the two rollers to rotate around their central axes, heating and introducing a superalloy blank from a gap between two first rollers to the deformation zone of the rolling machine; advancing the superalloy blank towards two second rollers.

4 Claims, 5 Drawing Sheets

(56) References Cited

U.S. PATENT DOCUMENTS

| | | | | | |
|---|---|---|---|---|---|
| 4,136,543 | A * | 1/1979 | Tuschy | B21B 3/00 | 72/78 |
| 4,512,177 | A * | 4/1985 | Hayashi | B21B 1/20 | 29/527.7 |
| 4,579,289 | A * | 4/1986 | Siebke | B02C 15/005 | 241/110 |
| 4,660,398 | A * | 4/1987 | Jour | B21B 13/008 | 72/100 |
| 5,713,234 | A * | 2/1998 | Yamakawa | B21B 19/04 | 72/97 |
| 7,146,836 | B2 * | 12/2006 | Hayashi | B21B 19/04 | 72/97 |
| 10,232,418 | B2 * | 3/2019 | Hayashi | B21B 19/04 | |

* cited by examiner

METHOD FOR PREPARING ULTRAFINE-GRAINED SUPERALLOY BAR

CROSS-REFERENCE TO RELATED APPLICATIONS

Pursuant to 35 U.S.C. § 119 and the Paris Convention Treaty, this application claims foreign priority to Chinese Patent Application No. 201910151226.4 filed Feb. 28, 2019, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to the field of mechanical processing, and more particularly to a method for preparing an ultrafine grained superalloy bar.

Severe plastic deformation (SPD) is a conventional process for the preparation of ultrafine grain/nano materials in the field of materials science. Specifically, SPD includes high-pressure torsion (HPT) method, equal channel angular pressing (ECAP) method, accumulative roll bonding (ARB) method, multidirectional forging (MF) method and torsion extrusion (TE) method.

Limited by the forming load, the HPT method is only applicable for the forming of ultra-thin products such as thin film, and the blank is limited to a cylinder with the thickness of 0.1-10 mm.

During the ECAP deformation process, the blank is in full contact with the mold, so the forming load and the friction force are relatively large. Therefore, the finished product is small-sized, and the material utilization rate and the production efficiency leave much to be desired. The normal diameter of the finished product processed by ECAP is 5-80 mm, and it is difficult to reach 100 mm.

Limited by the thickness of deformation zone, the ARB process can only produce ultra-thin plates with the thickness of 0.5-50 mm.

The grain refinement effect of MF and TE is significantly lower than that of ECAP and HPT. At the same time, the effective deformation zone of MF and TE is small, which leads to the uneven distribution of grain size.

SUMMARY

Provided is a method for preparing an ultrafine-grained superalloy bar, the method comprising:

1) designing a rolling machine comprising two rollers and two guide plates, wherein each of the two rollers is in the shape of a quasi-circular truncated cone and comprises a first roller and a second roller; the first roller comprises a first curve and the second roller comprises a second curve; the first curve and the second curve form a generatrix of the two rollers; the two guide plates each comprises a curved surface;
2) disposing the two guide plates with two curved surfaces thereof opposite to each other; disposing the two rollers to be between the two guide plates; wherein the two rollers and the two guide plates form a deformation zone of the rolling machine; the ovality of the deformation zone is constant;
3) selecting a superalloy blank having a diameter of 60-500 mm and a length of 300-15000 mm; and 4) driving the two rollers to rotate around their central axes, heating the superalloy blank and introducing the heated superalloy blank from a gap between two first rollers of the rolling machine to the deformation zone of the rolling machine; advancing the superalloy blank in a spiral manner in the deformation zone and outputting the superalloy blank being processed in the deformation zone from the second roller; and cooling the superalloy blank.

The connection line of two end points of the first curve is a first median; the connection line of two end points of the second curve is a second median; the maximum distance between the point on the first curve and the first median is not more than 5 mm, and the maximum distance between the point on the second curve and the second median is not more than 2.5 mm; and the included angle between the first median and the second median is 4-7 degrees.

The deformation zone comprises a first zone and a second zone; the first curve rotates around the axis of the first roller in the first zone to roll the superalloy blank; the second curve rotates around the axis of the second roller in the second zone to round the superalloy blank. The length of the first zone is 0.7-0.8 times the maximum diameter of the first roller. The length of the second zone is 0.3-0.4 times the minimum diameter of the second roller.

The first roller is a quasi-circular truncated cone, and the maximum diameter of the first roller is 3-6 times the diameter of the superalloy blank; the second roller is a quasi-circular truncated cone, and the minimum diameter of the second roller is 2.5-4 times the diameter of the superalloy blank.

The ovality refers to the ratio of the maximum distance between the two guide plates and the distance between the two rollers in one cross section of the deformation zone; and the ovality of any cross section in the deformation zone is constant, and the ovality is 1.06-1.08.

The superalloy blank is heated to 940-1140 degrees Celsius in a heating furnace, and the heating time T is $D_b \times (0.6\text{-}0.8)$ min, where $D_b$ is the diameter of the superalloy blank. In the deformation zone, the inclination of the cone angle of the first roller is 7-8 degrees; the feeding angle is 19-21 degrees; the cross angle is 22-24 degrees; the rotational speed of the rolling machine is 31-58 rpm; and the diameter reduction ratio is 42-59%; and the superalloy blank is cooled to room temperature in air or in water. The cone angle is an included angle between the first median and the axis of the superalloy blank. The feeding angle refers to the projection of an included angle between the axis of one of the two rollers and the axis of the superalloy blank along the connection line of rotation centers of the two rollers, and the cross angle refers to the projection of an included angle between the axis of one of the two rollers and the axis of the superalloy blank on the plane formed by a connection line of rotation centers of the two rollers and the axis of the superalloy blank. The rotation centers refer to the circle center of the minimum diameter of the first roller.

Figure 1:
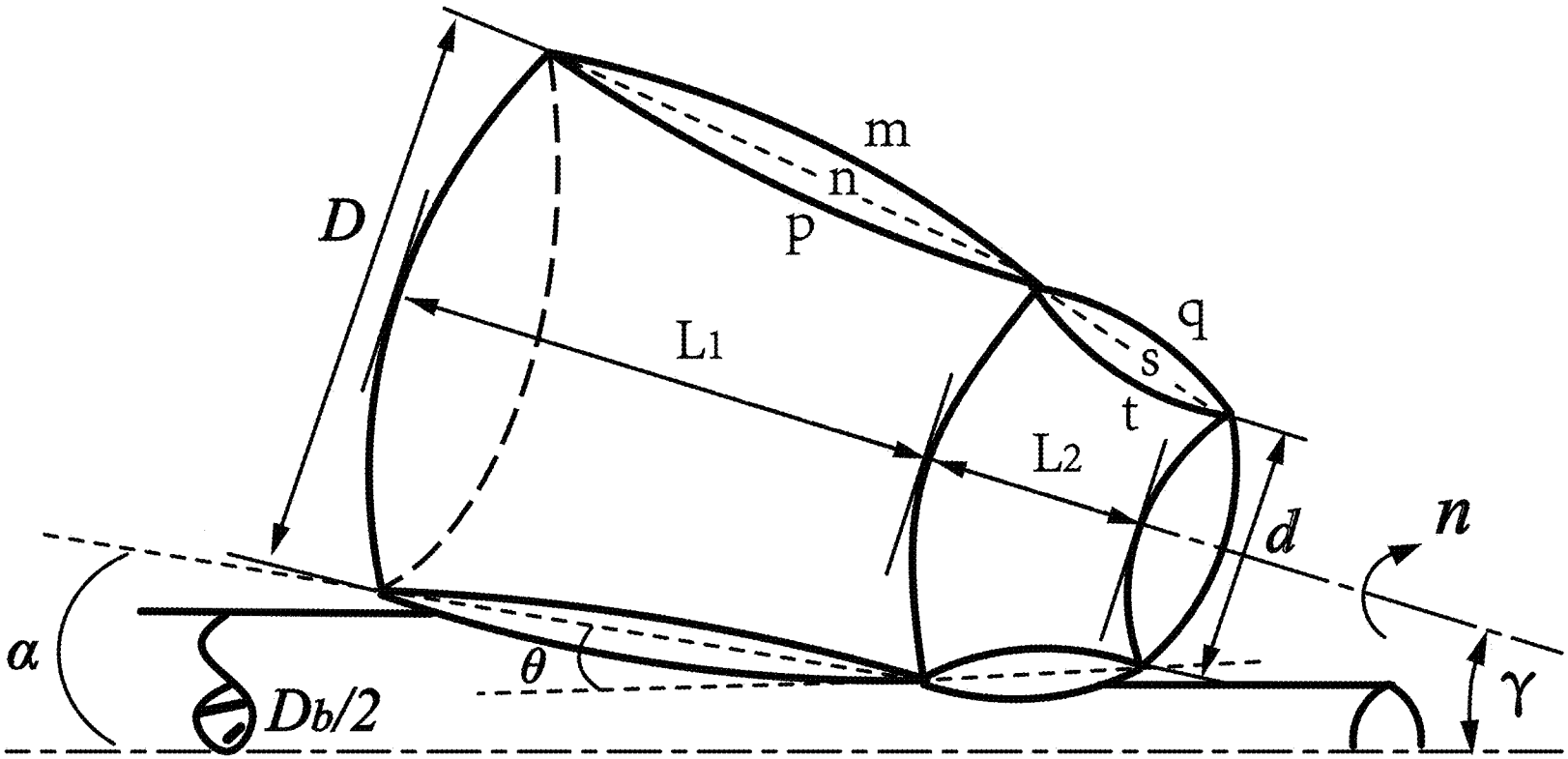
FIG. 1 is a schematic diagram of a roller according to one embodiment of the disclosure.
Figure 2:
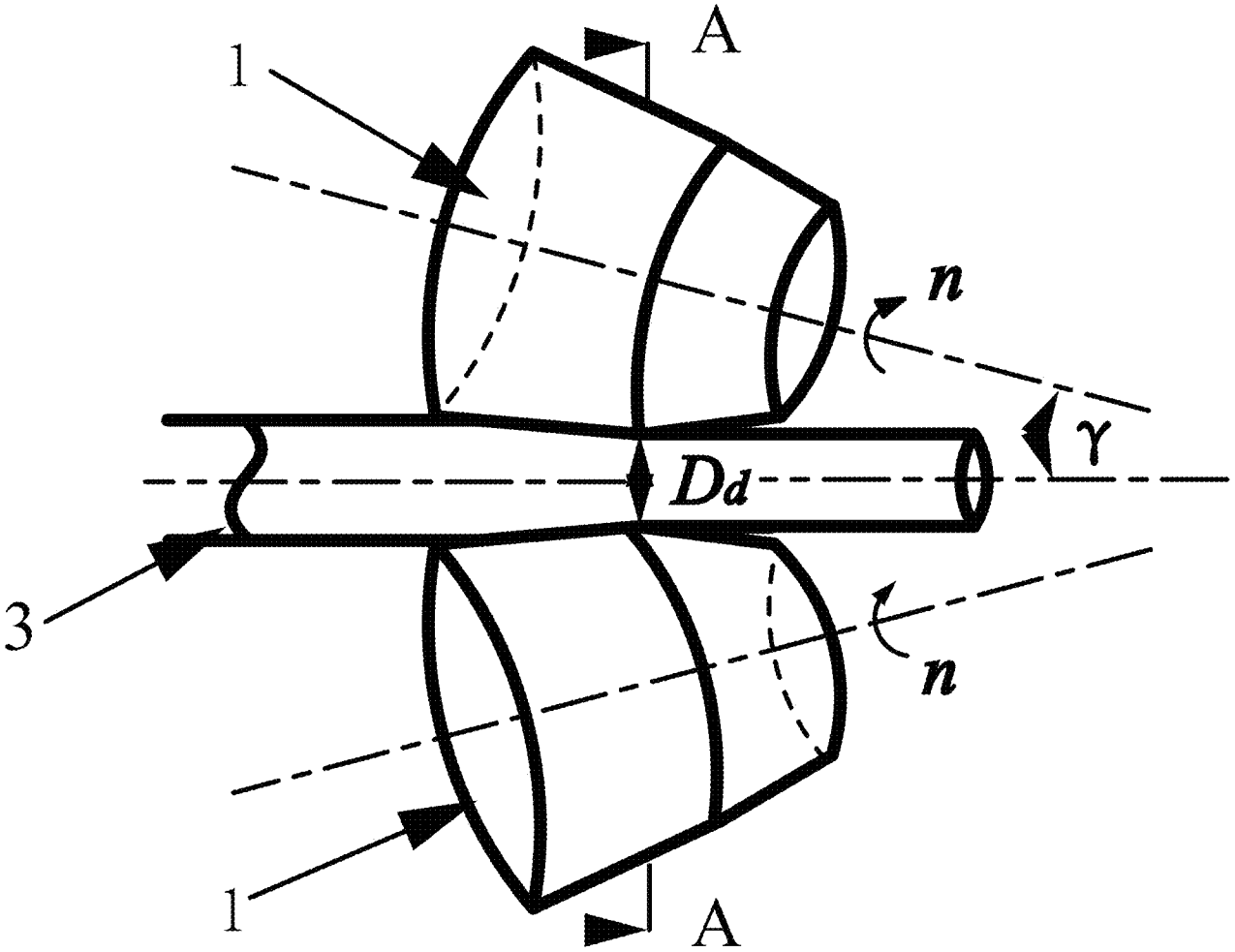
FIG. 2 is a front view of a rolling machine according to one embodiment of the disclosure.

In the drawing, the following reference numbers are used: 1. Roller; 2. Guide plate; 3. Superalloy blank.

DETAILED DESCRIPTIONS

To further illustrate, embodiments detailing a method for preparing an ultrafine-grained superalloy bar are described below. It should be noted that the following embodiments are intended to describe and not to limit the disclosure.

The disclosure provides a method for preparing an ultrafine-grained superalloy bar, the method comprising:

1) designing a rolling machine: the rolling machine comprises two rollers 1 and two guide plates 2; each of the two rollers 1 is in the shape of a quasi-circular truncated cone and comprises a first roller and a second roller; the first roller comprises a first curve and the second roller comprises a second curve; the first curve and the second curve form a generatrix of the two rollers 1; the two guide plates 2 each comprises a curved surface;

2) designing a deformation zone: disposing the two guide plates with two curved surfaces thereof opposite to each other; disposed the two rollers 1 to be between the two guide plates; the two rollers 1 and the two guide plates form a deformation zone of the rolling machine; the ovality of the deformation zone is constant;

3) selecting a superalloy blank 3 having a diameter of 60-500 mm and a length of 300-15000 mm, for example, superalloy blank Inconel 718;

4) driving the two rollers 1 to rotate around their central axes, heating the superalloy blank and introducing the superalloy blank 3 from a gap between two first rollers of the rolling machine to the deformation zone of the rolling machine; advancing the superalloy blank 3 in a spiral manner in the deformation zone and outputting the superalloy blank 3 being processed in the deformation zone from the second roller; and cooling the superalloy blank 3.

The connection line of the two end points of the first curve is a first median. The connection line of the two end points of the second curve is a second median. The maximum distance between the point on the first curve and the first median is not more than 5 mm, and the maximum distance between the point on the second curve and the second median is not more than 2.5 mm; the included angle between the first median and the second median is 4-7 degrees.

The deformation zone comprises a first zone and a second zone. The first curve rotates around the axis of the first roller in the first zone to roll the superalloy blank; the second curve rotates around the axis of the second roller in the second zone to round the superalloy blank. The length of the first zone is 0.7-0.8 times the maximum diameter of the first roller; the length of the second zone is 0.3-0.4 times the minimum diameter of the second roller.

The first roller is a quasi-circular truncated cone, and the maximum diameter of the first roller 1 is 3-6 times the diameter of the superalloy blank 3. The second roller is a quasi-circular truncated cone, and the minimum diameter of the second roller 1 is 2.5-4 times the diameter of the superalloy blank 3.

The ovality refers to the ratio of the maximum distance between the two guide plates 2 and the distance between the two rollers 1 in one cross section of the deformation zone. The ovality of any cross section in the deformation zone is constant, and the ovality is 1.06-1.08.

The superalloy blank 3 is heated to 940-1140 degrees Celsius in a heating furnace, and the heating time T is $D_b \times (0.6\text{-}0.8)$ min, where $D_b$ is the diameter of the superalloy blank 3.

In the deformation zone, the inclination $\alpha$ of the cone angle of the roller 1 is 7-8 degrees, the feeding angle $\beta$ is 19-21 degrees, the cross angle is 22-24 degrees, the rotational speed n of the roller 1 is 31-58 rpm, and the diameter reduction ratio $\varepsilon$ is 42-59%. The cone angle is an included angle between the first median and the axis of the superalloy blank. The feeding angle refers to the projection of an included angle between the axis of one of the two rollers and the axis of the superalloy blank along the connection line of rotation centers of the two rollers, and the cross angle refers to the projection of an included angle between the axis of one of the two rollers and the axis of the superalloy blank on the plane formed by a connection line of rotation centers of the two rollers and the axis of the superalloy blank. The rotation centers refer to the circle center of the minimum diameter of the first roller.

The superalloy blank 3 is cooled to room temperature in the air or in water.

Example 1

The example takes a superalloy blank Inconel 718 with a diameter of 84 mm and length of 400 mm as an example.

1) Designing a rolling machine: the rolling machine comprises two rollers 1 and two guide plate 2; each of the two rollers 1 is in the shape of a quasi-circular truncated cone and comprises a first roller and a second roller; the first roller comprises a first curve and the second roller comprises a second curve; the first curve and the second curve form a generatrix of the two rollers 1. As shown in FIG. 1, the connection line of the two end points of the first curve is a first median n. The first curve is a convex curve m with respect to the first roller or a concave curve p with respect to the first roller. The maximum distance between the point on the first curve and the first median is not more than 5, preferably, 3 mm. The connection line of the two end points of the second curve is a second median s. The second curve is a convex curve q with respect to the second roller or a concave curve t with respect to the second roller. The maximum distance between the point on the second curve and the second median is not more than 2.5, preferably, 2 mm. The included angle $\theta$ between the first median and the second median is 4.5 degrees. Each of the two guide plates 2 comprises a curved surface; the first roller is a quasi-circular truncated cone, and the maximum diameter D of the first roller is 410 mm. The second roller is a quasi-circular truncated cone, and the minimum diameter d of the second roller is 260 mm.

2) Designing a deformation zone: the two guide plates with two curved surfaces thereof are disposed opposite to each other; the two rollers 1 are disposed between the two guide plates; the two rollers 1 and the two guide plates form a deformation zone of the rolling machine. The deformation zone comprises a first zone and a second zone. The first curve rotates around the axis of the first roller in the first zone to roll the superalloy blank; the second curve rotates around the axis of the second roller in the second zone to round the superalloy blank. The length L1 of the first zone is 310 mm, and the length L2 of the second zone is 100 mm.

Figure 3:
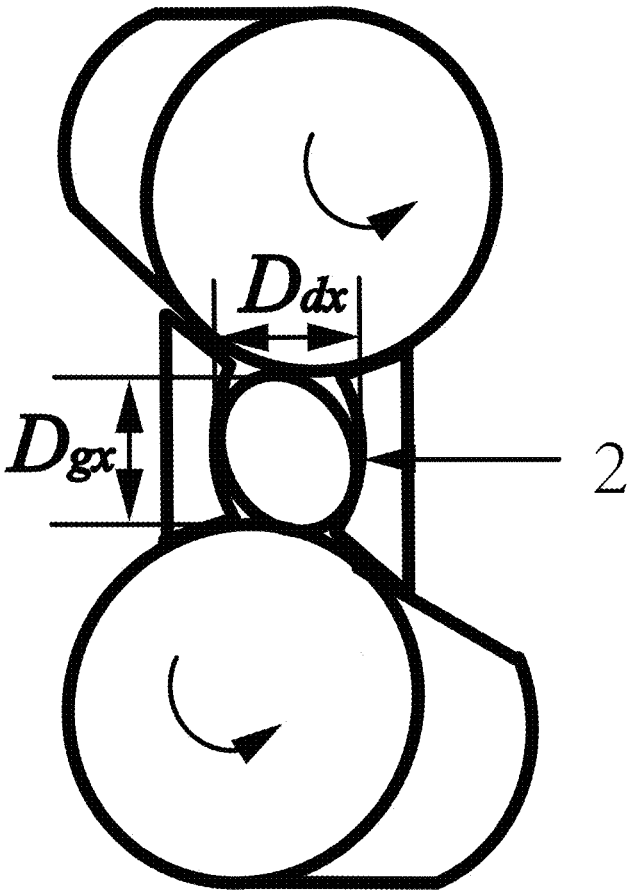
FIG. 3 is a sectional view taken from line A-A in FIG. 2.
Figure 4:
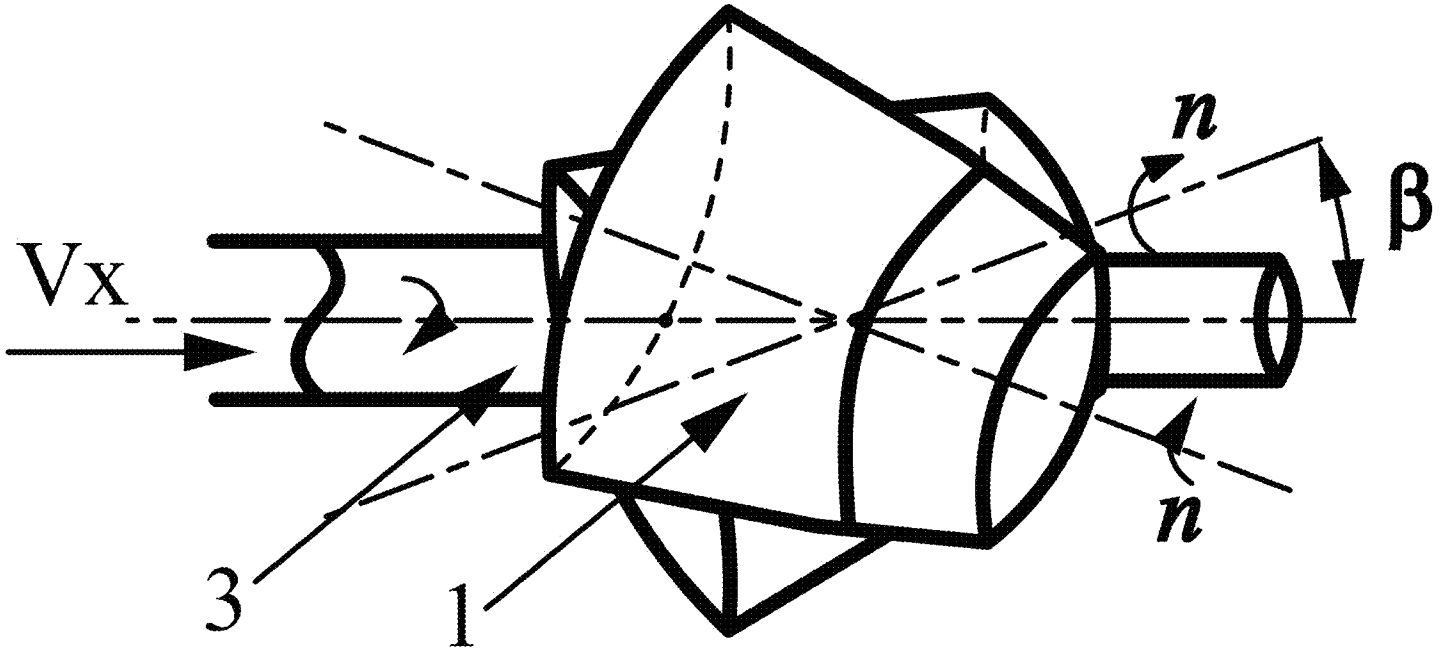
FIG. 4 is a top view of a rolling machine according to one embodiment of the disclosure.

3) The ovality of the deformation zone is constant; the ovality refers to the ratio of the maximum distance $D_{dx}$ between the two guide plates 2 and the distance $D_{gx}$ between the two rollers 1 in one cross section of the deformation zone. As shown in FIG. 3, the ovality of any cross section in the deformation zone is constant, and the ovality is 1.06.

4) Superalloy blank Inconel 718 having a size of Φ84×400 mm is purchased. All parts of the cylindrical superalloy blank 3 are uniform, without defects such as inclusions and pores.

5) The superalloy blank 3 is introduced from a gap between two first rollers of the rolling machine to the deformation zone of the rolling machine.

6) Rolling procedure: the two rollers 1 are driven to rotate around their central axes, respectively. The superalloy blank 3 is heated in a heating furnace, where the heating temperature is 960 degrees Celsius, and the heating time T is 55 min. Then the heated superalloy blank Inconel 718 is transferred from the heating furnace to the guide groove of the rolling machine within the transfer time of 11 seconds. The process parameters of the rolling procedure are as follows: in the deformation zone, the inclination α of the cone angle of the first roller 1 is 8 degrees; the feeding angle β is 20.5 degrees; the cross angle γ is 24 degrees; the rotational speed n of the roller 1 is 31 rpm, and the diameter reduction ratio ε is 55%. The heated superalloy blank 3 is introduced from a gap between two first rollers of the rolling machine to the deformation zone of the rolling machine, advances in a spiral manner in the deformation zone, and is then output from the second roller. After the rolling procedure is completed, the superalloy blank 3 is cooled to room temperature.

Figure 5:
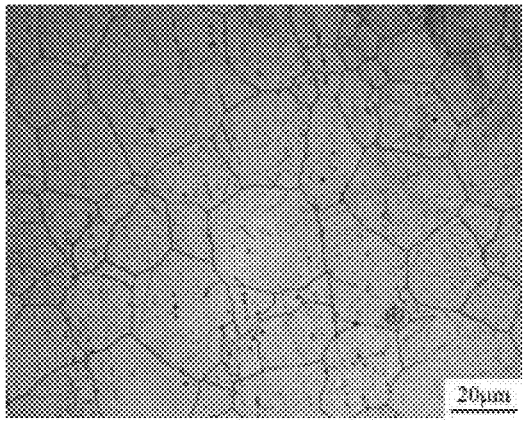
FIG. 5 shows an initial microstructural diagram of a superalloy blank.
Figure 6:
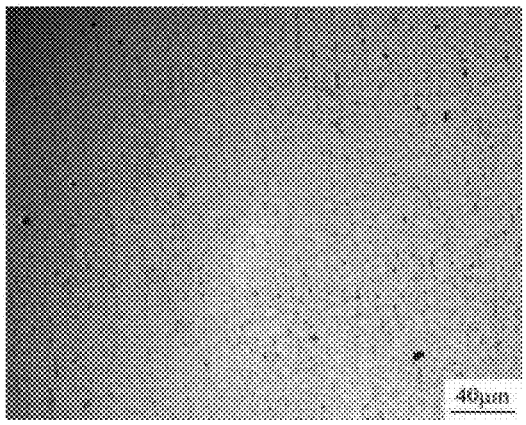
FIG. 6 shows a microstructural diagram of a prepared superalloy blank according to the method for preparing an ultrafine-grained superalloy bar of the disclosure.

The initial structure of the superalloy blank is shown in FIG. 5, and the average grain size is 113 μm. FIG. 6 shows the microstructure of the superalloy blank Inconel 718 after the rolling procedure is completed. The grain size is about 4.2 μm and the grain refinement is 96.3%.

The reasonable design of the technical parameters comprising the feeding angle, the cross angle, the rotation speed, and the ovality of the rolling machine reduces the lateral spread deformation of the superalloy bar, reduces the tensile stress in the center of the roller, reduces the number of repeated rolling, reduces the Mannesman effect, reduces the probability of the occurrence of the crack and increase the deformation uniformity.

The superalloy blank is introduced to the deformation zone for plastic deformation. With the decrease of the diameter of the first roller in the deformation area, the speed of the first roller along the rolling direction gradually reduces, and the advance speed of the superalloy blank is reduced. This is favorable to reducing the deformation unevenness of the superalloy blank along the axial direction, improving the deformation uniformity.

The included angle between the first median and the second median is 4-7 degrees, which can effectively control the ratio of the length of the first zone for rolling the superalloy blank to the length of the second zone for rounding the rolled superalloy bar, and improve the surface quality and deformation uniformity of the rolled workpiece. The rolling zone is a single cone with a sharp reduction of diameter, the inclination of the cone angle of the first roller is 7-8 degrees, which is 2-4 times of that of conventional Mannesman-type cross rolling. This can double the compression deformation of the diameter per unit time, and the large plastic deformation degree can always maintained, so that the grain refining effect will gradually strengthened and the grain refining effect will be better.

In the deformation process, the superalloy blank is in local contact with the two roller 1, which can effectively reduce the rolling load.

It will be obvious to those skilled in the art that changes and modifications may be made, and therefore, the aim in the appended claims is to cover all such changes and modifications.

What is claimed is:

1. A method using a rolling machine for reducing a cross-section of a superalloy blank and thereby producing a superalloy bar, the method comprising:

1) preparing the rolling machine comprising two rollers and two guide plates, wherein each of the two rollers comprises a first section and a second section, and comprises a rotational axis that the roller rotates about; the first section and the second section each are in a shape of a circular truncated cone, the circular truncated cone comprising a bottom base, a top base that has a smaller diameter than the bottom base, and a lateral surface that is formed by rotating a generatrix around the rotational axis; the generatrix is curved and therefore the lateral surface is concave or convex; the generatrix comprises a virtual chord connecting two endpoints of the generatrix; the top base of the first section is connected to the bottom base of the second section; a diameter of the top base of the first section is identical to a diameter of a bottom base of the second section; the bottom base of the first section forms a wide end of the roller; the top base of the second section forms a narrow end of the roller; and the two guide plates each comprise a curved surface;

2) disposing the two guide plates opposite to each other wherein the curved surfaces of the two guide plates face each other; disposing the two rollers between the two guide plates, thereby forming a deformation zone of the rolling machine between the two rollers and the two guide plates and defining a pass line longitudinally along the deformation zone;

wherein:

the two rollers are axially symmetrical with each other 180° around the pass line; the rotational axis of one of the two rollers tilts with respect to the pass line such that a center of the narrow end of the roller is closer to the pass line than a center of the wide end;

an ovality of a cross-section of the deformation zone is constant along the pass line; wherein the ovality of the cross-section of the deformation zone represents a ratio of a minimum distance between the two plates to a minimum distance between the two rollers in the cross-section of the deformation zone; and a cone angle α is in the range of 7° to 8°; a cross angle γ is in the range of 22° to 24°; a feed angle β is fixed and is in the range of 19° to 21°; a rotational speed of the rollers is in the range of 31 to 58 rpm; a slant angle of the first section is 4° to 7° larger than a slant angle of the second section;

wherein:

the cone angle represents an angle formed by the virtual chord of the generatrix for the first section and the pass line of the superalloy blank;

the cross angle represents an angle formed by the pass line and the projection of the rotational axis of one of the two rollers on a first plane passing through the pass line;

the feed angle represents an angle formed by the pass line and the projection of the rotational axis of one of the two rollers on a second plane passing through the pass line and perpendicular to the first plane; and the slant angle of the circular truncated cone represents an angle formed by the virtual chord of the generatrix and the bottom base of the circular truncated cone;

3) selecting a superalloy blank having a diameter of 60-500 mm and a length of 300-15000 mm; and 4) heating the superalloy blank and feeding the heated superalloy blank into the deformation zone of the rolling machine via a gap between the wide ends of the two rollers; rotating the two rollers such that the superalloy blank rotates around the pass line and moves along the pass line to a gap between the narrow ends of the two rollers; and after the superalloy blank moves out from the deformation zone, cooling the superalloy blank.

2. The method of claim 1, wherein the diameter of the wide end of one of the two rollers is 3-6 times a diameter of the superalloy blank; and the diameter of the narrow end of one of the two rollers is 2.5-4 times the diameter of the superalloy blank.

3. The method of claim 1, wherein the ovality of cross section of the deformation zone is in a range of 1.06-1.08.

4. The method of claim 1, wherein the superalloy blank is heated to 940-1140 degrees Celsius in a heating furnace, and a heating time T is Db×(0.6-0.8) min, where Db is a diameter of the superalloy blank;

a diameter reduction ratio of the superalloy blank is 42-59%; and the superalloy blank is cooled to room temperature in air or in water.

* * * * *